United States Patent [19]

Gunning

[11] Patent Number: 5,016,377

[45] Date of Patent: May 21, 1991

[54] FIREARM LOADING LOCKOUT DEVICE

[76] Inventor: Dade Gunning, 1845-A S. Main St., Waterbury, Conn. 06706

[21] Appl. No.: 459,513

[22] Filed: Jan. 2, 1990

[51] Int. Cl.[5] ..... F41A 17/02

[52] U.S. Cl. ..... 42/70.11

[58] Field of Search ..... 42/70.11, 96; 70/30, 70/49, 58

[56] References Cited

U.S. PATENT DOCUMENTS

| | | | |
|---|---|---|---|
| 3,137,957 | 6/1964 | Ingalls | 42/70.11 |
| 3,435,642 | 4/1969 | Del Pesco | 70/49 |
| 3,708,901 | 1/1973 | Wolter | 42/70.11 |
| 3,710,490 | 1/1973 | Cornett et al. | 42/70.11 |
| 3,720,014 | 3/1973 | Goodrich | 42/70.11 |
| 3,765,197 | 10/1973 | Foote | 70/49 |
| 3,841,118 | 10/1974 | Stone | 70/49 |
| 3,933,015 | 1/1976 | Balicki | 70/49 |
| 3,991,594 | 11/1976 | Goenner | 70/30 |
| 4,075,878 | 2/1978 | Best | 70/49 |
| 4,302,955 | 12/1981 | Kawakami | 70/30 |
| 4,398,403 | 8/1983 | Menick | 70/58 |
| 4,543,806 | 10/1985 | Papandrea et al. | 70/30 |
| 4,867,478 | 9/1989 | Anderson | 70/30 |

FOREIGN PATENT DOCUMENTS

| | | | |
|---|---|---|---|
| 22837 | 12/1912 | Norway | 42/70.11 |

*Primary Examiner*—Charles T. Jordan

[57] ABSTRACT

A device is disclosed for preventing unauthorized loading and discharge of firearms. Unlike other devices that prevent trigger action, or disable firearms by interfering with the function of their mechanisms, the device disclosed prevents loading of the firearm by blocking the barrel bore with a cable or other flexible means which is securely locked externally to the barrel, thereby blocking a cartridge from the firing position.

3 Claims, 5 Drawing Sheets

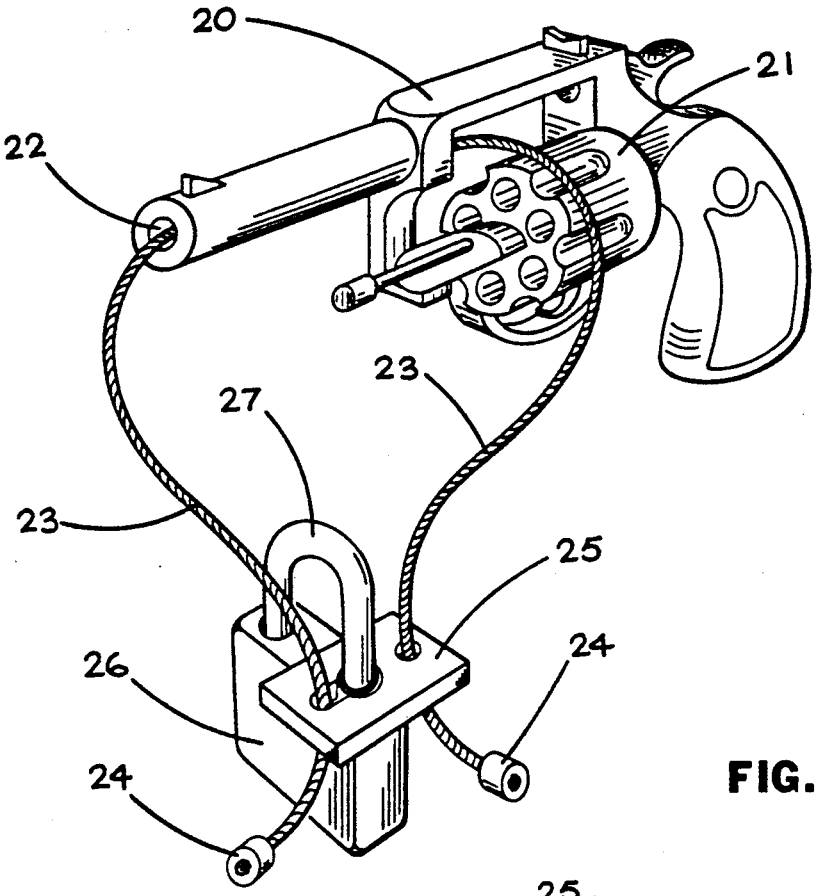
FIG. 1
FIG. 2
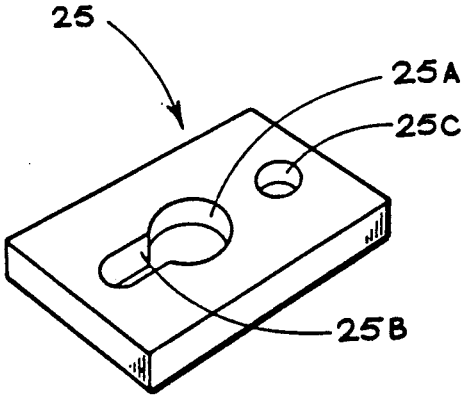

FIREARM LOADING LOCKOUT DEVICE

BACKGROUND OF THE INVENTION

The field of my invention is firearm safety.

Most prior art addresses the disabling of various parts of the firearm. For example, a popular item currently sold in gun shops is a trigger blocking device that is installed by screwing together two pieces using a special screwdriver having two small points. This device offers protection for the person who is concerned about young children handling or playing with the firearm unsupervised, but a teenager with mechanical skills can easily shape a piece of metal with which to remove the screw, or even remove the screw with a pointed instrument, and thereby defeat the device. Furthermore, a trigger blocking device does not prevent either the loading or the cocking of the firearm, which might then be discharged in consequence of receiving a sharp blow as in being dropped.

The object of the Goenner U.S. Pat. No. 3,991,594, is antitheft or antiintrusion only, and involves at least two more features than my invention.

Best, in his U.S. Pat. No. 4,075,878, defines a cable lock especially adapted for relatively heavy cables. Significant features of Best's invention are the rotatability of the cable end members, desirable in heavy cables that tend to be very stiff and awkward to handle. The cable of my invention is relatively light, and the cable and members as described in FIG. 8, which I call "fittings," are not essentially rotatable. One end of the cable is permanently affixed by any practical manufacturing means to the lock body. The other end of the cable is fitted with a fitting that is formed with a notch of the configuration typically found on the insertable end of padlock shackles. Although this notch may be formed as an annular ring for simplicity of insertion, in my embodiment it may just as well require orientation for insertion. A further distinction of my insertable fitting is its bullet shaped tip, which facilitates insertion through the bore of the barrel. Also significant in the Best patent is his claim of a dual chamber core. In my invention, the core of the lock body is in keeping with the long established padlock technology that preceded Best.

An essential feature of my invention is the electroplating or coating of all members in order to prevent scratching or marring of the firearm to which it is applied. Best's patent does not recite or claim any such features.

And finally, Best makes no claim to apply his invention as a lockout means.

Balicki, in his U.S. Pat. No. 3,933,015, discloses a tamper-proof cable lock assembly having a series of sheath-like armor sections covering a cable. The object of my invention does not demand a tamper-proof design.

Stone's U.S. Pat. No. 3,841,118 covers a cable lock that claims only theft prevention of snowmobiles, motorcycles, outboard motors, and bicycles using a pair of mating lock sections that straddle the cable.

DelPesco, in his expired U.S. Pat. No. 3,435,642, discloses a flexible shackle lock. The thrust of DelPesco's patent is a unique latching mechanism that is simpler and less expensive than locks existing at that time. My invention includes features that differ essentially from DelPesco, namely: no dependency on a specific lock mechanism; any conventional lock may be adapted for assembly with the cable of my invention; the lock body of my invention must be electroplated or coated to prevent marring or scratching of the firearm to which it is applied; cable fittings on my invention must be relatively small so as to pass through the bore of small caliber firearms; my invention is a lockout device, and does not claim the broad uses of locking devices in general. These several distinctions demonstrate that the embodiment of my invention as shown in FIG. 8 is a new use for a cable lock.

Essential to Foote's U.S. Pat. No. 3,765,197 is a box within which a cable lock is enclosed, a feature not desired in my invention. Further, the object of Foote's invention is theft prevention.

Menick's U.S. Pat. No. 4,398,403 involves multiple locking areas and a housing useful primarily to prevent theft of skis and ski poles.

Papandrea's U.S. Pat. No. 4,543,806 involves a housing and a coil spring retraction mechanism for the cable.

Foote's, Menick's, and Papandrea's patents all involve far more mechanism and features than my present invention.

Kawakami's U.S. Pat. No. 4,302,955 is narrowly prescribed for bicycle use only.

In the material that follows I will disclose a more positive device than any of the aforementioned devices. My invention prevents the loading of a cartridge into the firing position, and therefore prevents the discharge of the firearm by occupying the barrel bore with a cable or other strong, flexible means that is externally secured by a locking means.

OBJECTS AND ADVANTAGES OF THE INVENTION

Each year an appalling number of young people die as a result of mishandled firearms. Often these mishaps result when the owner of the firearm is away from home, and the young person plays with the firearm in the presence of a friend.

Firearm owners often attempt to hide their weapons, especially handguns, but curious youngsters, knowing that a firearm is somewhere in the home, seek it out and often find it.

To prevent surreptitious handling, firearm owners have sometimes locked their rifles and shotguns in cabinets, and locked their handguns in safes or security boxes. Whereas such measures will seldom stop a thief, they are usually effective enough to prevent a family member from handling or playing with the firearm. Unfortunately, the cost of cabinets and safes are quite high, and few gun owners invest in them.

Trigger locks have also been devised, but certain of these can be defeated without leaving evidence.

To date, no known practical, positive lockout device that prevents the loading of the firearm, and the full closing of the action, such as the invention I disclose herein, has been published or commercialized. Further, no known device having essentially the same object as my invention demonstrates visually that a cartridge cannot be in the loaded position; the presence of the cable installed through the bore of the firearm assures that no bullet can simultaneously pass through that bore.

Any attempt to defeat my invention, whether or not successful, will cause sufficient obvious damage to ensure discovery. Thus, my invention, in a sense, is a "poor man's gun safe," not something that will discourage a professional thief, but a device that prevents casual, unsupervised, surreptitious handling from resulting in catastrophe.

In addition to providing protection against the hazards of unauthorized firing of the firearm, my invention can increase the utility of such weapon. In many cases where a firearm is not stored in a safe, gun cabinet, etc., the person responsible for it is apprehensive about keeping the firearm loaded. To some extent this detracts from the utility of the weapon because any emergency use requires locating the ammunition, which must also be hidden, perhaps remotely, and loading the firearm. This is an unduly time-consuming procedure. My device allows the firearm to be stored safely in a nearly loaded condition, for example, a loaded cylinder or loaded magazine, because no cartridge can be installed in the firing position until the cable is removed.

A BRIEF DESCRIPTION OF THE DRAWINGS

FIG. 1 is a view showing the preferred embodiment of the invention in place in a revolver.

FIG. 2 is an enlarged and detailed view of the plate shown in FIG. 1.

LIST OF REFERENCE NUMERALS

Figure 3:
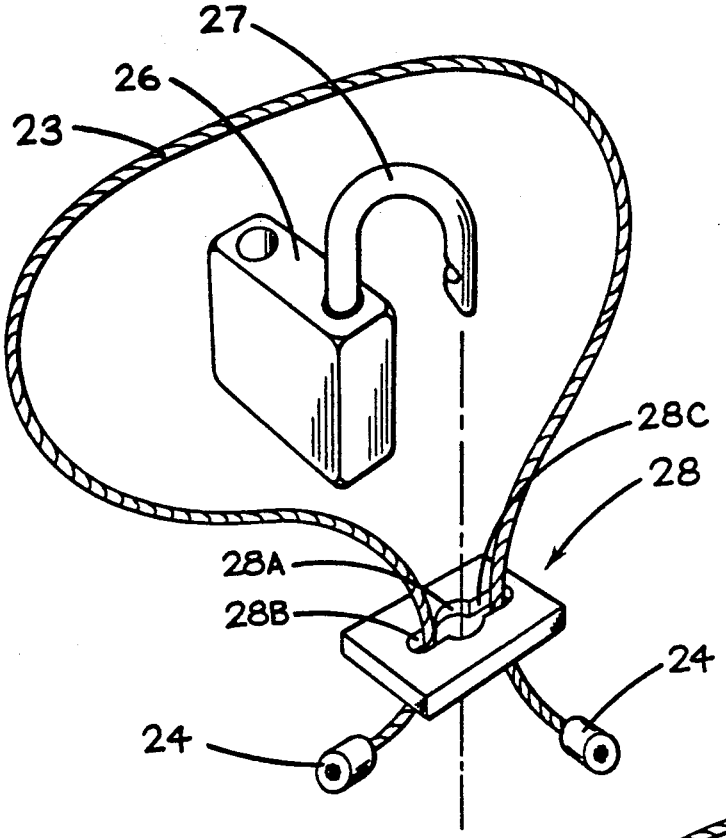
FIG. 3 is another embodiment of the invention of FIG. 1 in which the plate is not captive to the cable.

20 is a revolver, which typifies handguns.

21 is the cylinder of revolver 20.

22 is the bore of revolver 20.

23 is the flexible cable.

24 is the fitting installed on the flexible cable 23.

25 is the plate of the FIG. 1 embodiment.

25(*a*) is the hole in plate 25 through which fitting 24 and shackle 27 pass.

25(*b*) is the slot into which cable 23 recedes at installation.

25(*c*) is the hole through which cable 23 is secured in the FIG. 1 embodiment.

26 is the lock.

27 is the shackle of lock 26.

28 is the plate of the FIG. 3 embodiment.

28(*a*) is the hole in plate 28 through which fitting 24 and shackle 27 pass.

28(*b*) is a slot in plate 28 into which cable 23 recedes at installation.

28(*c*) is a second slot in plate 28 into which cable 23 recedes at installation.

Figure 8:
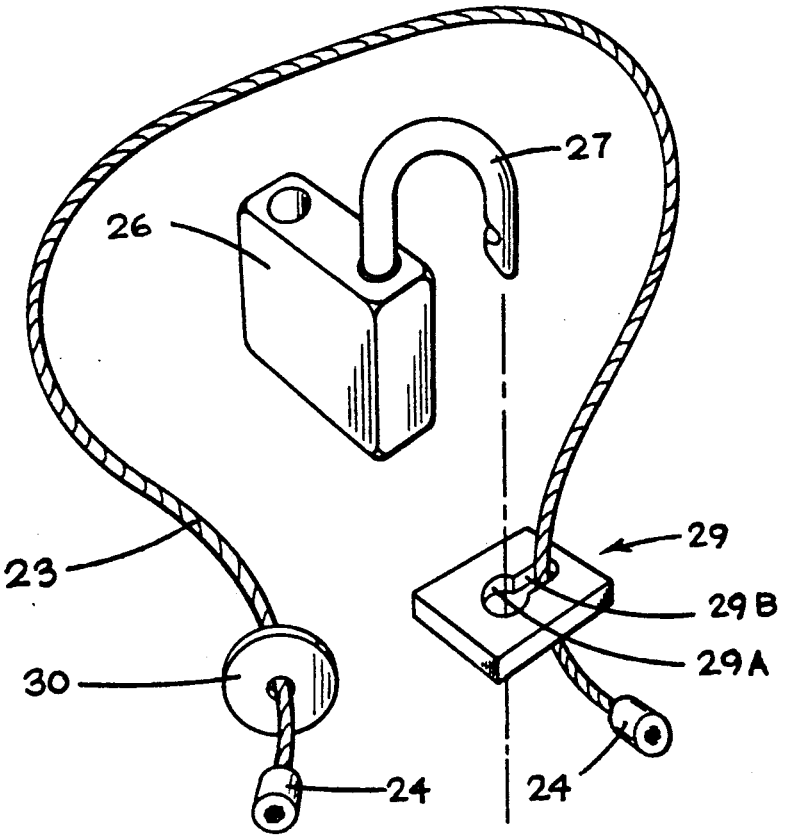
FIG. 8 is an embodiment of the invention in which the cable ends are not joined in the installed mode.

29 is the plate of the FIG. 8 embodiment.

29(*a*) is the hole in plate 29 through which fitting 24 and shackle 27 pass.

29(*b*) is the slot in plate 29 into which cable 23 recedes at installation.

30 is a washer.

Figure 4:
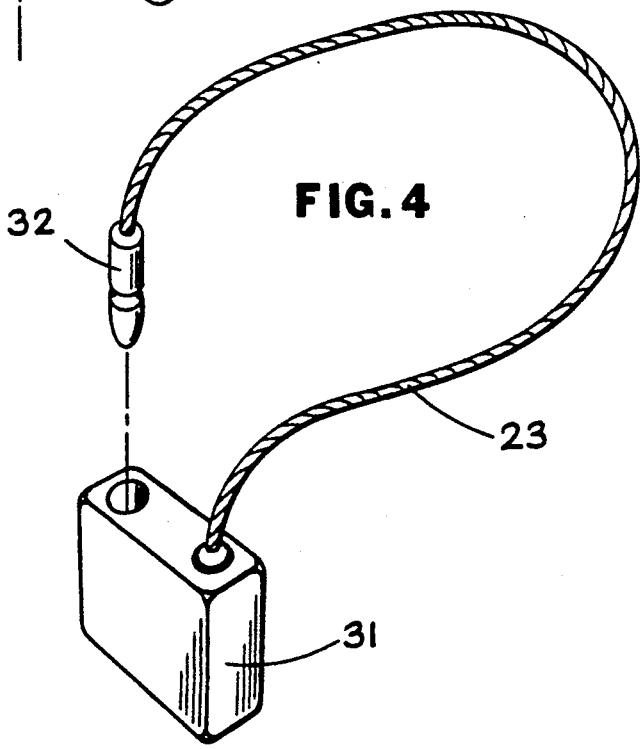
FIG. 4 is another embodiment of the invention of FIG. 1 in which the cable is lockable without the use of the plate, and in which the lock is permanently attached to the cable.

31 is the lock of the FIG. 4 embodiment.

32 is the fitting that is captured by lock 31.

33 is a another embodiment of lock 31.

Figure 6:
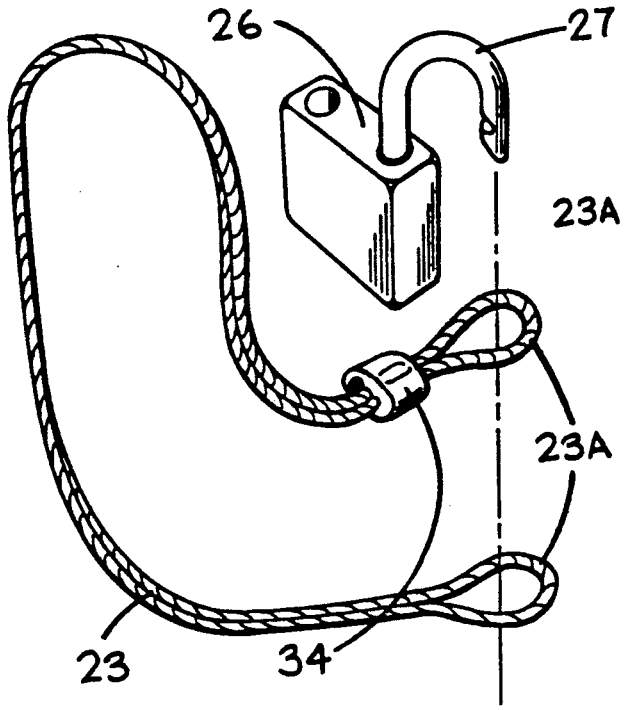
FIG. 6 is another embodiment of the invention of FIG. 1 in which the cable is lockable without the use of the plate, and in which the lock is separable from the cable.

34 is a fitting that joins the ends of cable 23 in the FIG. 6 embodiment.

35 is a fitting that joins the ends of cable 23, and through which shackle 27 passes.

DETAILED DESCRIPTION OF THE INVENTION

In accordance with the preferred embodiment of the invention, there is shown in FIG. 1 a view of a revolver 20 with its cylinder 21 in the opened position. One end of cable 23 is permanently installed through the small hole 25(*c*) in plate 25, and prevented from removal by fitting 24, which is larger than hole 25(*c*). The other end of cable 23 is shown passed through the bore 22 of the revolver 20 barrel, and thence through large hole 25(*a*) in plate 25, where it is shown moved into position in slot 25(*b*), thereby having left large hole 25(*a*) free to receive shackle 27 of lock 26 to pass through large hole 25(*a*). The lock 26 is shown with shackle 27 installed in large hole 25(*a*) and locked. The end of cable 23, shown positioned in slot 25(*b*), is prevented from removal from plate 25 by fitting 24, which is larger than slot 25(*b*) or any space surrounding shackle 27 and between it and large hole 25(*a*).

FIG. 2 shows the openings in plate 25 unassembled and in greater detail than in FIG. 1.

Materials for construction of the embodiment shown in FIGS. 1 and 2 may vary widely. For example, the cable, preferably fabricated of steel, could be made of other suitable strong and flexible materials such as alloys like beryllium copper, or even polymers like nylon, aramid, various composites, etc.

There is an advantage in using cable over chain in that cable can be conveniently introduced into the bore in any position, and pushed, whereas chain, even if covered in a sheath, tends to be balky unless the barrel is more or less vertically positioned during insertion. Chain, or chain-like assemblies, however, certainly qualify as a flexible member for substitution in place of cable.

Steel cable, the material of the preferred embodiment, has the advantage of being plentiful in a variety of sizes and strand configurations. It is very strong, durable, difficult to sever, and economical, and it conveys the desired image of security.

To prevent marring or scratching of the firearm, the cable 23, in the preferred embodiment, is covered with a polymer or elastomer such as nylon, vinyl, urethane, etc.

A variety of ways are known to configure the ends of the cable so that at least one end may engage a lock. The preferred embodiment of FIG. 1 consists of a plate 25 through which both ends of the cable pass, one end being permanently captured by the plate 25, and the other end being captured only after it is passed through a larger hole 25(*a*), moved to one side in a small adjoining slot 25(*b*), and then prevented from being removed through the same hole by the presence of shackle 27.

Both ends of the cable in the preferred embodiment of FIG. 1 are terminated with conventional cable fittings 24 that are approximately cylindrical or approximately spherical in shape, and made from copper or other relatively soft material, which prevents scratching or marring of the barrel or any other parts it may contact.

The plate 25 shown in FIG. 1 can be made from a wide variety of strong materials. The nature of this invention does not prevent anyone from sawing or filing through the various members, or cutting them with a bolt cutter. Thus, plate 25 could be molded from a strong polymer, such as nylon reinforced with carbon fibers, glass fibers, etc. Another method of manufacture would be die casting from zinc or other metals or alloys. In the preferred embodiment of FIG. 1, however, plate 25 is stamped from a mild steel, and is electroplated with a soft metal such as copper or zinc, or is coated with a polymer or elastomer such as vinyl or urethane to prevent marring or scratching of the firearm.

The lock 26 shown in FIG. 1 that prevents disassembly and removal of the cable from the firearm barrel can be of the ordinary key-operated padlock variety. A combination lock could be used just as well. An important feature of any such lock is that it be electroplated with soft metal, such as copper, in order to prevent accidental scratching or marring of the firearm. Rubber, urethane, vinyl, or in fact any suitable coating that is durable may be substituted for the copper electroplating. Alternatively, the body of the lock could be made of brass.

It should be noted that lock 26 is freely removable from the other members of the preferred embodiment, and can be easily changed for increased security.

A variation of the preferred embodiment is shown in FIG. 3. The main variation is found in plate 28, which has a large hole 28(*a*) for the free passage of fittings 24 and shackle 27, and two slots 28(*a*) and 28(*b*) adjoining large hole 28 (*a*) that serve as convenient niches into which cable 23 recedes in order to install shackle 27. Except that both ends of cable 23 are free, and one end is not permanently installed in plate 28 as it is in the case of plate 25 of FIG. 1, the operation and use of the FIG. 3 variation is substantially the same as the FIG. 1 operation.

Another embodiment of my invention is shown in FIG. 4. Cable 23 is fitted with an end fitting 32 that is a functional component of lock 31. End fitting 32 can be designed in a wide range of shapes, but a cylindrical shape having a substantially spherical tip provides the advantage of easy insertion through the bore 22 of FIG. 1. This embodiment has the advantage that none of its components are separable, and cannot be lost from each other.

Figure 5:
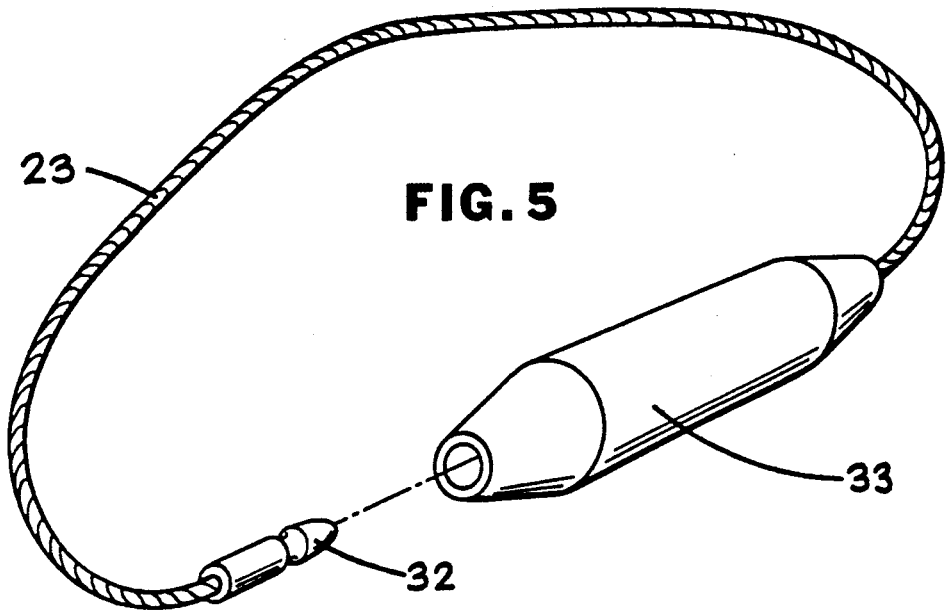
FIG. 5 is an alternate embodiment of the FIG. 4 embodiment.

Another variation of my preferred embodiment is shown in FIG. 5. The operation of this variation is identical with FIG. 4 except that lock 33 is shown substantially cylindrical in shape, and is shown coaxial with cable 23, although the cylindrical shape and the coaxiality are not essential to this variation's function, and other configurations could be used just as well.

Another variation of my preferred embodiment is shown in FIG. 6. In addition to its coating to prevent marring and scratching of the firearm, cable 23 is covered at various points along its length with a thin sheath, or the two adjacent cable members are cemented, molded, welded, etc. so as to act as a single cable for easy insertion into bore 22 FIG. 1. The ends of cable 23 are secured by fitting 34. The end of cable 23 that does not have a fitting is formed as a tight loop 23(*a*) for easy insertion in bore 22 FIG. 1, but is sufficiently flexible to allow easy passage of shackle 27.

Figure 7:
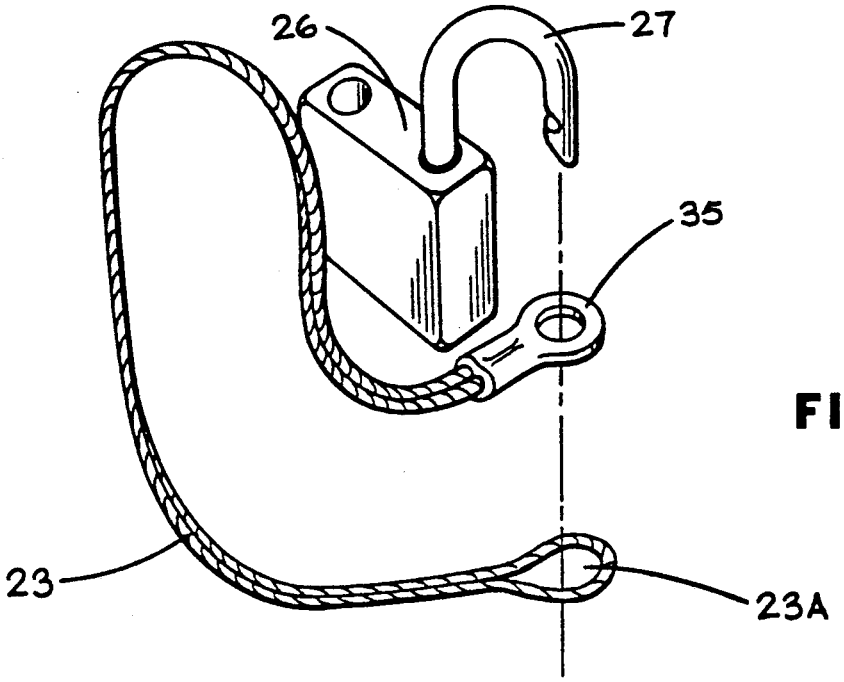
FIG. 7 is an alternative embodiment of the FIG. 6 embodiment.

Still another variation of my preferred embodiment is shown in FIG. 7, which employs a fitting 35 rather than a loop in the cable. Fitting 35 has a hole sufficiently large to receive the shackle 27 of lock 26. Operation of this variation is similar to that of embodiment of FIG. 6 in that one end of cable 23 does not have a fitting but is configured as a loop 23(*a*) that is insertable through the bore 22 FIG. 1 of the barrel.

FIG. 8 shows a third variation of the plate 25 that is essential in the preferred embodiment. In this variation plate 29 has only one slot 29 (*b*) and one hole 29 (*a*). Passage of cable 23 and its fitting 24 through hole 29 (*a*) and into slot 29 (*b*) are substantially the same as the preferred embodiment FIG. 1. An end fitting sufficiently large as to prevent its admittance into the bore 22 FIG. 1 of a firearm is attached permanently to cable 23. In FIG. 8 this fitting is shown as a washer 30 prevented from disassembly by fitting 24. A single piece fitting that assembles to the cable, and is too large to fit in the bore 22 FIG. 1 could just as well serve the same purpose as the combination of fitting 24 and washer 30. In the FIG. 8 variation of the preferred embodiment, lock 26 and plate 29 must be sufficiently large as to be impossible to pass through the bore of the firearm. The FIG. 8 embodiment departs from the preferred embodiment in that the ends of the flexible member are not joined.

Figure 9:
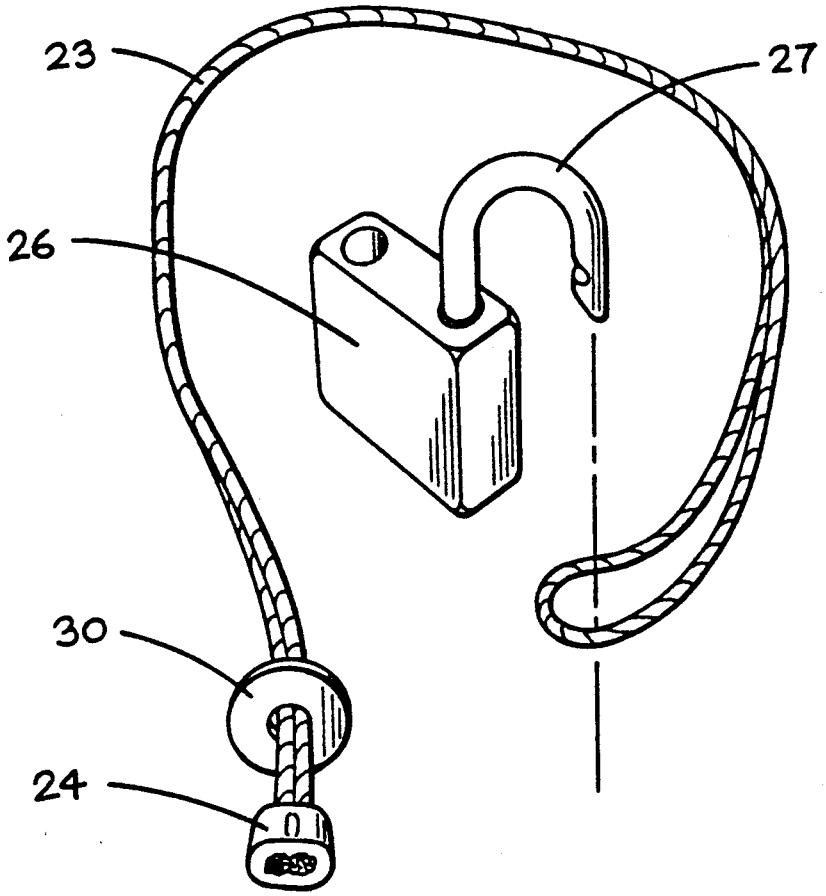
FIG. 9 is an alternative embodiment of the FIG. 8 embodiment.

FIG. 9 is a variation of the FIG. 8 embodiment in that a fitting 24 and washer 30 terminate one end of the cable 23, and this combination is sufficiently large as to prevent passage through bore 22 FIG. 1. Rather than employ any of the plates 25, 28, or 29, or variations thereof, this embodiment uses the loop 23 (*a*) in cable 23 as in FIG. 6 and FIG. 7 through which shackle 27 of lock 26 passes easily. Lock 26 must be sufficiently large as to be impossible to pass through the bore of the firearm.

In all of the above embodiments a great number of other combinations of the components are possible, and the absence of many more words and drawings showing these practicable combinations is not to be construed as oversight. Also obvious to those of ordinary skill in the art will be that numerous changes and modifications may be made to this invention without departing from its spirit and scope. All such changes and modifications are intended to fall within the scope of the invention as defined in the claims below. Further, in the interests of saving tedious repetitions I will list four features that should be understood to apply to all embodiments whatsoever:

1. Cable 22 length is devised in a variety of lengths to accommodate a range of barrel sizes from the smallest handgun to the longest shotgun.

2. All essential members such as cable 22, plates 25, 28, and 29, locks 26, 31, and 33, fittings 24, 32, 34, and 35, and so on can be scaled up in size and strength to accommodate a canon, if so desired, or scaled down smaller to accommodate miniature firearms or firearms carried in restrictive holsters, cases, purses, and so on.

3. Any manner of lock, whether a conventional key or combination lock, or any other ordinary or exotic locking means using magnetic or electronic means, cards, push buttons etc. can be substituted for the locks shown without changing the novelty of my invention.

4. All members are understood to be electroplated or coated with other materials such as will prevent marring, scratching, or other damage to the firearm.

Having thus described my invention, what I claim is:

1. A firearm loading lockout device that prevents a firearm from being loaded and discharged either accidentally or intentionally comprising in combination:

(a) a flexible member that is passed through the bore of the barrel of said firearm, thereby blocking a cartridge from being loaded into firing position, or, thereby preventing the mechanism of the firearm from being closed into the firing position, or both;

(b) at least one termination fitting that is affixed to at least one end of said flexible member, and which is smaller in cross section than the bore of said firearm;

(c) a plate that has a hole through which the shackle of a lock and said termination fitting may pass independently, and a slot that adjoins said hole through which said flexible member may pass freely, but through which said termination fitting cannot pass;

(d) a lock that has a shackle that passes freely through said hole, but said shackle is sufficiently large in cross section that said termination fitting cannot pass through said hole when said shackle occupies said hole.

2. A firearm loading lockout device as in claim 1 in which said plate has a second hole that is independent of said first hole, and through which said flexible member may pass, but through which said termination fitting may not pass.

3. A firearm loading lockout device as in claim 1 in which said plate has a second slot that is independent of said first slot and adjoins said first hole, and said second slot is sufficiently large that said flexible member passes through it freely, but said termination fitting cannot pass.

* * * * *